US009460479B1

(12) United States Patent
Butler

(10) Patent No.: US 9,460,479 B1
(45) Date of Patent: Oct. 4, 2016

(54) DISPENSABLE SMART TARGET/ RE-USABLE SMART TARGET

(75) Inventor: Bruce Ormonde Butler, Hampshire (GB)

(73) Assignee: Trimble Navigation Ltd, Sunnyvale, CA (US)

( * ) Notice: Subject to any disclaimer, the term of this patent is extended or adjusted under 35 U.S.C. 154(b) by 285 days.

(21) Appl. No.: 13/225,363

(22) Filed: Sep. 2, 2011

(51) Int. Cl.
*G06Q 50/08* (2012.01)

(52) U.S. Cl.
CPC ..... *G06Q 50/08* (2013.01)

(58) Field of Classification Search
CPC ..... G06Q 50/08
USPC ..... 235/375
See application file for complete search history.

(56) References Cited

U.S. PATENT DOCUMENTS 7,295,955 B2 11/2007 Sit
7,389,922 B2 * 6/2008 Yoshimura ..... G06Q 10/087 235/382
7,720,703 B1 * 5/2010 Broughton ..... G06Q 10/06313 705/7.23
2004/0049739 A1 * 3/2004 McArdle et al. ..... 715/513
2004/0111360 A1 * 6/2004 Albanese ..... 705/38
2008/0046109 A1 * 2/2008 Freeman et al. ..... 700/114
2008/0084333 A1 * 4/2008 Forrest et al. ..... 340/989
2009/0272803 A1 * 11/2009 Solla et al. ..... 235/385
2010/0295699 A1 * 11/2010 Rushing ..... 340/825.49
2012/0066019 A1 * 3/2012 Hinshaw ..... G06Q 10/06 705/7.23
2012/0136475 A1 * 5/2012 Kahle ..... 700/182
2012/0323534 A1 * 12/2012 Kahle et al. ..... 703/1

OTHER PUBLICATIONS

Xie et al. Implementation of BIM/RFID in Computer-Aided Design-Manufacturing-Installation Process. Jul. 9-11, 2010. Computer Science and Information Technology (ICCSIT), 2010 3rd IEEE International Conference on (vol. 2). pp. 107-111.*

* cited by examiner

*Primary Examiner* — Toan Ly
(74) *Attorney, Agent, or Firm* — Kilpatrick Townsend & Stockton LLP

(57) ABSTRACT

A method for aiding construction of a building is proposed. The building includes a plurality of building components. The method comprises: (A) providing at least one building component marking attached to at least one building component, (B) providing at least one RFID tag, and C) of using at least one building component marking to identify at least one building component on the building site. An RFID tag is attached to at least one building component. The RFID tag is configured to store a predetermined location of at least one building component on a building site. A building component marking is selected from the group consisting of: an optical reflective target; and a physical marking.

18 Claims, 3 Drawing Sheets

DISPENSABLE SMART TARGET/ RE-USABLE SMART TARGET

CROSS-REFERENCES TO RELATED APPLICATIONS

The following three regular U.S. patent applications (including this one) are being filed concurrently, and the entire disclosures of the other applications are incorporated by reference into this application for all purposes: application Ser. No. 13/225,003, filed on Sep. 2, 2011, entitled "Method and System for Position Determination Using RFID Devises"; application Ser. No. 13/225,363, filed on Sep. 2, 2011, entitled "Dispensable Smart Target/Re-usable Smart Target"; and application Ser. No. 13/225,014, filed on Sep. 2, 2011, entitled "Method and system for surveying using RFID devices".

TECHNICAL FIELD

The technology relates to the utilization of RFID tags, and more specifically, to the usage of RFID in the construction industry.

BACKGROUND OF THE TECHNOLOGY

Construction companies and maintenance organizations face a unique set of asset management and operational challenges during the best of times. Given the tight economic and budget conditions we face today, keeping a closer eye on the location of tools and equipment, and ensuring a safe working environment is more important than ever.

Having access to timely and accurate information about the location and status of critical assets such as tools and equipment are directly related to successful completion of a project and a company's bottom line. With the advanced technologies and innovations in the construction industry, it has become both technically and economically viable to integrate the use of automated data collection methods—like Radio-Frequency IDentification (RFID) technology into daily operations.

Current shortcoming of the available solutions: when a component or object is delivered to a building, plant or construction site etc. it is not immediately obvious where it needs to be placed.

SUMMARY

This Summary is provided to introduce a selection of concepts that are further described below in the Detailed Description. This Summary is not intended to identify key or essential features of the claimed subject matter, nor is it intended to be used as an aid in determining the scope of the claimed subject matter.

A method for aiding construction of a building is proposed. The building includes a plurality of building components. The method comprises: (A) providing at least one building component marking attached to at least one building component; and (B) providing at least one RFID tag, wherein said RFID tag is attached to at least one building component. The RFID tag is configured to store a predetermined location of at least one building component on a building site. A building component marking is selected from the group consisting of: an optical reflective target; and a physical marking.

The method further comprises the step (C) of using at least one building component marking to identify at least one building component on the building site.

DESCRIPTION OF THE DRAWINGS

The accompanying drawings, which are incorporated in and form a part of this specification, illustrate embodiments of the technology and, together with the description, serve to explain the principles below.

DETAILED DESCRIPTION

Reference now is made in detail to the embodiments of the technology, examples of which are illustrated in the accompanying drawings. While the present technology will be described in conjunction with the various embodiments, it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following detailed description, numerous specific-details are set forth in order to provide a thorough understanding of the presented embodiments. However, it will be obvious to one of ordinary skill in the art that the presented embodiments may be practiced without these specific details. In other instances, well known methods, procedures, components, and circuits have not been described in detail as not to unnecessarily obscure aspects of the presented embodiments.

Figure 1A:
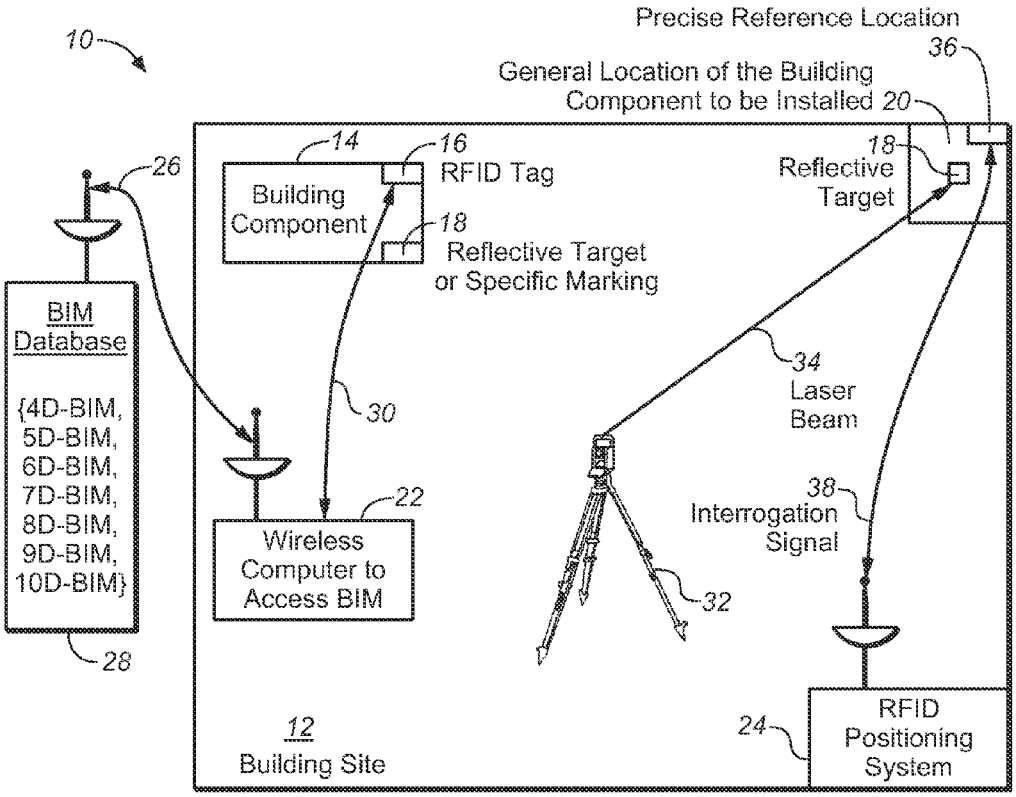
FIG. 1A illustrates a block diagram of a construction site equipped with the technology of the present technology including at least one building component marking attached to at least one building component and configured to identify a building component, and at least one RFID tag attached to at least one building component and configured to identify position coordinates of the location on the building site where the identified building component has to be installed.

In an embodiment of the present technology, FIG. 1A illustrates a block diagram 10 of a construction site 12 equipped with the present technology, including at least one building component marking 18 attached to the building component 14 and configured to identify the building component 14, and at least one RFID tag 16 attached to the building component 14 and configured to identify position coordinates of the general location 20 on the building site 12 where the identified building component 14 has to be installed.

In an embodiment of the present technology, the construction site 12 comprises a building site, a chemical plant, a stadium, a theater, a pyramid, or any other object of human endeavor that requires a set of bundling components to be assembled according to a predetermined project for its physical construction.

In an embodiment of the present technology, a building component marking is selected from the group consisting of: an optical reflective target; and a physical marking.

In an embodiment of the present technology, wherein a building component marking comprises a reflective target, a laser beam 34 hits the reflective target 18 configured to identify the general location on the building wherein the building component 14 is to be installed, as shown in FIG. 1A.

Figure 1B:
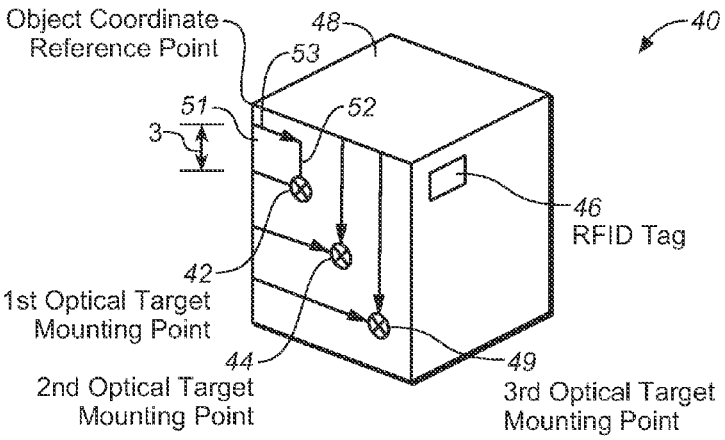
FIG. 1B illustrates three optical targets configured to identify the location of the building component is to be installed in more details.

In an embodiment of the present technology, FIG. 1B is a diagram 40 that illustrates three optical targets 42, 44, and 49 configured to identify the location of the building component 48 is to be installed in more details.

In an embodiment of the present technology, as shown in FIG. 1B, for example, the optical target 42 is mounted on the spot. 52 that has a predetermined location on the object, in an object coordinate system, which is 3 inches down and 3 inches to the right from the top left corner of the face of the object, so that this point 52 on the object is matched to a location in the BIM, exactly.

In an embodiment of the present technology, a reflex sight can be used to implement an optical reflective target 18.

In an embodiment of the present technology, a reflex sight is an optical or computing sight that reflects a reticle image (or an image) onto a combining glass for superimposition on the target. Reflex sights are most commonly configured as non-magnifying firearm sights (such as the Aimpoint CompM2 red dot sight), but they are also used to aid targeting on other devices, such as telescopes and point and-shoot digital cameras. Reflex sights should not be confused with laser sights, which actually project a point of light directly onto a target.

Reflex sights use refractive or reflective optical collimators to generate a collimated image of a luminous or reflective reticle. This collimated image is reflected off a dichroic mirror or beam splitter to allow the viewer to see the field of view and a reflection of the projected reticle (e.g. a red dot) simultaneously. If no magnification is utilized, this gives the viewer a theoretically parallax-free image of the reticle, superimposed over the field of view at infinity.

A reflex sight with no magnification can be held at any distance from the eye (see eye relief), and at almost any angle, without distorting the image of the target or reticle, and without causing the reticle to "move" relative to the target. But parallax compensation is not perfect, and depending on the sights design, the range to the target, and the magnitude of angle at which it is looked into, aiming error can be non-trivial due to parallax.

Sights that use dot reticles are almost invariably measured in minutes of angle, or "MOA". One of the most common reticles used in red dot sights is a small dot, covering 5 MOA (1.5 mrad), illuminated by a red LED, hence the common term "red dot sight". MOA is a convenient measure for shooters using English units, since 1 MOA subtends approximately 1.0472 inches at a distance of 100 yards (91.44 m). This is generally rounded to 1 inch at 100 yards, which makes MOA a handy unit to use in ballistics. The 5 MOA (1.5 mrad) dot is small enough not to obscure most targets, and large enough to quickly acquire a proper "sight picture". For many types of action shooting, a larger dot is preferred; 7 (2.0 mrad), 10 (2.9 mrad), 15 (4.4 mrad) or even 20 MOA (5.8 mrad) dots or rings are used; often these will be combined with horizontal and/or vertical lines to provide a level reference.

Many reticle illumination and pattern options are available. Common light sources used in reflex sights include battery powered lights, fiber optic light collectors, and even tritium capsules. Some reflex sights are specifically designed to be visible when viewed through night vision devices. The color of a reflex sight reticle is often red or amber for visibility against most backgrounds, but green is becoming widely available as well. Reticle shapes are not limited to dots; e.g. some reflex sights use a chevron or triangular pattern instead, to aid precision aiming and range estimation, and still others provide selectable patterns and holographic reticles.

Some of the first optical reflex sights to appear were "occluded" red dot sights; that is, the image of the target was not visible through the sight. Looking into the sight with just one eye, the shooter saw only a red dot against a black background (often passively illuminated with ambient light gathered through fiber optics). With both eyes open, the image of the dot was superimposed by the brain onto the target. Most currently available reflex sights use a curved partially reflective glass surface as an objective lens. This lens allows light from the target to pass into the device, collimating it with the light of the reticle before it reaches the ocular lens, thus allowing the shooter the tactical flexibility of using either one- or two-eyed aiming.

Modern optical reflex sights designed for firearms and other uses fall into three housing-configuration categories: full tube, open, and small tube. Full tube sights look similar to standard telescopic sights, with a cylindrical tube containing the optics. Many full tube sights offer the option of interchangeable filters (such as polarizing or haze-reducing filters), glare-reducing sunshades, and conveniently protective "flip-up" lens covers.

Open sights (also known as "mini reflex sights" and "mini red dots") take advantage of the fact that reflex units require only a single reflective surface, and are offered in configurations consisting of a single loop of optical material, allowing objective light to pass through while also providing the necessary reflective surface for collimating the reticle. While some argue that the open design gives the shooter a wider field of view, the actual circumscribed viewable range of the dot is not usually significantly larger than that of a typical full tube sight, and if two-eyed sighting is used, the overall field-of-view is identical to that of a full tube design. Open sights often weigh less than full tube sights (since less construction material is required), which could be construed as a non-trivial tactical consideration. Due to their diminished profile, open sights do not usually accommodate filters and other accessory options typically supported by tube designs.

Small tube sights attempt to combine the advantages of full tube sights (most notably the ability to accept filter and sunshade attachments), while maintaining the larger field-of-view occlusion claimed to be provided by open-style reflex sights.

Referring still to FIG. 1, in an embodiment of the present technology, a physical marking on a building component is selected from the group consisting of an optical marking; an IR marking; an UV marking; a mechanical marking detectable by sound waves; and a mechanical marking detectable by ultra sound waves.

Referring still to FIG. 1, in an embodiment of the present technology, at least one physical marking can be located by using an electronic device selected from the group consisting of: an optical device; and infrared (IR) device; an ultraviolet (UV) device; sonar; and an ultrasound sonar device.

Referring still to FIG. 1, in an embodiment of the present technology, a tag 16 can be implemented by using Radio-frequency identification (RFID) technology that uses communication through the use of radio waves to exchange data between a reader and an electronic tag attached to an object, for the purpose of identification and tracking.

Referring still to FIG. 1, in an embodiment of the present technology, a tag 16 can be implemented by using at least one long range RFID tag; wherein the long range RFID tag is configured to generate radio signals that are detectable within the range of the building site.

It is possible in the near future, RFID technology will continue to proliferate in our daily lives the way that bar code technology did over the forty years leading up to the turn of the 21st century bringing unobtrusive but remarkable changes when it was new.

RFID makes it possible to give each product in a grocery store its own unique identifying number, to provide assets, people, work in process, medical devices etc. all with individual unique identifiers—like the license plate on a car but for every item in the world. This is a vast improvement over paper and pencil tracking or bar code tracking that has been used since the 1970s. With bar codes, it is only possible to identify the brand and type of package in a grocery store, for instance.

Furthermore, passive RFID tags (those without a battery) can be read if passed within close enough proximity to an RFID reader. It is not necessary to "show" them to it, as with a bar code. In other words it does not require line of sight to "see" an RFID tag, the tag can be read inside a case, carton, box or other container, and unlike barcodes RFID tags can be read hundreds at a time. Bar codes can only read one at a time.

Some RFID tags can be read from several meters away and beyond the line of sight of the reader. The application of bulk reading enables an almost-parallel reading of tags.

Radio-frequency identification involves the hardware known as interrogators (also known as readers), and tags (also known as labels), as well as RFID software or RFID middleware. The novel RFID tags are selected from the group consisting of: a High Frequency (HF) RFID tag; and an Ultra High Frequency (UHF) RFID tag.

Most RFID tags contain at least two parts: one is an integrated circuit for storing and processing information, modulating and demodulating a radio-frequency (RF) signal, and other specialized functions; the other is an antenna for receiving and transmitting the RF signal.

RFID can be either passive (using no battery), active (with an on-board battery that always broadcasts or beacons its signal) or battery assisted passive "BAP" which has a small battery on board that is activated when in the presence of an RFID reader. Passive tags in 2011 start at $0.05 each and for special tags meant to be mounted on metal, or withstand gamma sterilization go up to $5. Active tags for tracking containers, medical assets, or monitoring environmental conditions in data centers all start at $50 and can go up over $100 each. BAP tags are in the $3-10 range and also have sensor capability like temperature and humidity.

Figure 2:
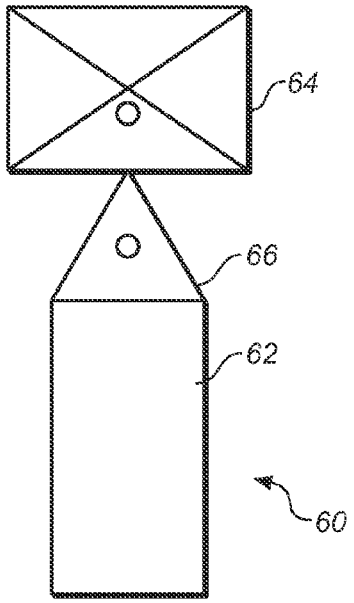
FIG. 2 depicts a building component including an RFID tag coupled to an optical reflective target for the purposes of the technology of the present technology.

In an embodiment of the present technology, FIG. 2 depicts a building component 62 including an RFID tag 64 coupled to an optical reflective target 66.

In an embodiment of the present technology, the RFID tag 64 includes the location of the RFID tag, for example, a GPS location of the RFID tag.

In an embodiment of the present technology, the RFID tag 64 includes the location of the reflective target 66 (or other optical device adjacent the RFID tag) and/or the distance between the RFID tag 64 and a building component 62

In an embodiment of the present technology, the RFID tag 64 and the reflective optical target 66 (or other fixed point) do not need to be coincident, collinear, or the like, but can have various different spatial relationships to each other. For instance, the RFID tag 64 can be separated from the reflective target 66 with a predetermined spatial relationship between the two items. In this case, the RFID tag includes information about the location of the reflective target, the RFID tag, and the relationship between them.

In an embodiment of the present technology the RFID tag 64 can also include other identifying information (not shown) like a physical marking comprising a readable serial number of the building component that can be readable by using an electronic device selected from the group consisting of: an optical device; and infrared (IR) device; an ultraviolet (UV) device; a sonar; and an ultrasound sonar device.

Figure 3:
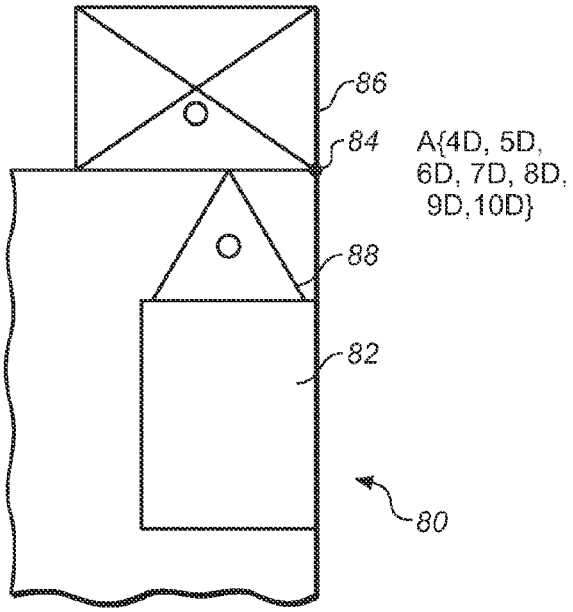
FIG. 3 shows a building component including an RFID tag coupled to the optical reflective target and mounted on a specific point A of the building site for the purposes of the present technology.

In an embodiment of the present technology, FIG. 3 shows a building component 82 including an RFID tag 86 coupled to the optical reflective target 88 and mounted on a specific point A 84 of the building site.

In an embodiment of the present technology, the specific point A can include different type of data, including 4-D data, 5-D data, 6-D data, 7-D data, 8-D data, 9-D data, and 10-D data. Please, see detailed discussion below.

In an embodiment of the present technology, referring still to FIG. 1A, the BIM database 28 comprises a predetermined database of a building to be constructed, or a computer assisted design (CAD) of a building to be constructed.

In an embodiment of the present technology, referring still to FIG. 1A, the BIM database 28, can be accessed (for instance, by using a wireless computer 22) to download to RFID tag 16 position coordinates data (including 4-D data, 5-D data, 6-D data, 7-D data, 8-D data, 9-D data, and 10-D data) of the location wherein the building component 14 is to be installed.

In an embodiment of the present technology, referring still to FIG. 1A the wireless computer 22 utilizes a Wi-Fi wireless access means 26, or a Bluetooth wireless access means 26 to get access to the BIM database 28.

In an embodiment of the present technology, referring still to FIG. 1A the wireless computer 22 is selected from the group consisting of: a smart phone; a tablet computer; a portable media player; a netbook; a smartbook; and an e-Reader.

Building Information Modeling (BIM) is the process of generating and managing building data during its life cycle. Typically it uses three-dimensional, real-time, dynamic building modeling software to increase productivity in building design and construction.

This process produces the Building Information Model (also abbreviated BIM), which encompasses building geometry, spatial relationships, geographic information, and quantities and properties of building components.

Building information modeling covers geometry, spatial relationships, light analysis, geographic information, quantities and properties of building components (for example manufacturers' details). BIM can be used to demonstrate the entire building life cycle, including the processes of construction and facility operation. Quantities and shared properties of materials can be extracted easily. Scopes of work can be isolated and defined. Systems, assemblies and sequences can be shown in a relative scale with the entire facility or group of facilities.

Under the guidance of a Virtual Design to Construction Project Manager (VDC) BIM can be seen as a companion to PLM as in the Product Lifecycle Management, since it goes beyond geometry and addresses issues such as Cost Management, Project Management and provides a way to work concurrently on most aspects of building life cycle processes.

BIM goes far beyond switching to new software. It requires changes to the definition of traditional architectural phases and more data sharing than most architects and engineers are used to. BIM is able to achieve such improvements by modeling representations of the actual parts and pieces being used to build a building. This is a substantial shift from the traditional computer aided drafting method of drawing with vector file-based lines that combine to represent objects.

The interoperability requirements of construction documents include the drawings, procurement details, environmental conditions, submittal processes and other specifications for building quality. It is anticipated by proponents that VDC utilizing BIM can bridge the information loss associated with handing a project from design team, to construction team and to building owner/operator, by allowing each group to add to and reference back to all information they acquire during their period of contribution to the BIM model. For example, a building owner may find evidence of a leak in his building. Rather than exploring the physical building, he may turn to his BIM and see that a water valve is located in the suspect location. He could also have in the model the specific valve size, manufacturer, part number, and any other information ever researched in the past, pending adequate computing power. Such problems were initially addressed by Leite et al. when developing a vulnerability representation of facility contents and threats for supporting the identification of vulnerabilities in building emergencies.

There have been attempts at creating a BIM for older, pre-existing facilities. They generally reference key metrics such as the Facility Condition Index (FCI). The validity of these models will need to be monitored over time, because trying to model a building constructed in, say 1927, requires numerous assumptions about design standards, building codes, construction methods, materials, etc., and therefore is far more complex than building a BIM at time of initial design.

The American Institute of Architects has further defined BIM as "a model-based technology linked with a database of project information", and this reflects the general reliance on database technology as the foundation. In the future, structured text documents such as specifications may be able to be searched and linked to regional, national, and international standards. The production of a Building Information Model (BIM) for the construction of a project involves the use of an integrated multi-disciplinary performance model to encompass the building geometry, spatial relationships, geographic information, along with quantities and properties of the building components. The Virtual Design to Construction Project Manager (VDC—also known as VDCPM) is a professional in the field of project management and delivery. The VDC is retained by a design build team on the clients' behalf from the pre-design phase through certificate of occupancy in order to develop and to track the object oriented BIM against predicted and measured performance objectives. The VDC manages the project delivery through multi-disciplinary building information models that drive analysis, schedules, take-off, and logistics. The VDC is skilled in the use of BIM as a tool to manage and assess the technology, staff, and procedural needs of a project. In short the VDC is a contemporary project managing architect who is equipped to deal with the current evolution of project delivery. The VDC acts as a conduit to bridge time tested construction knowledge to digital analysis and representation.

In an embodiment of the present technology, referring still to FIG. 1A, the BIM database 28 includes a 4-D Predetermined Building Information Modeling (BIM) database; wherein each element in the 4-D Predetermined Building Information Modeling (BIM) database comprises a building component and its predetermined 3-D location coordinates.

In an embodiment of the present technology, referring still to FIG. 1A, the BIM database 28 includes a 5-D Predetermined Building Information Modeling (BIM) database created for a building; wherein each element in the 5-D Predetermined Building Information Modeling (BIM) database comprises a building component; its predetermined 3-D location coordinates; and its predetermined timing coordinate, that is the time of placing the building component into its predetermined 3-D location.

In an embodiment of the present technology, referring still to FIG. 1A, the BIM database 28 includes a 6-D Predetermined Building Information Modeling (BIM) database created for a building; wherein each element in the 6-D Predetermined Building Information Modeling (BIM) database comprises a building component; its predetermined 3-D location coordinates; its predetermined timing coordinate; and an associated cost.

In an embodiment of the present technology, referring still to FIG. 1A, the BIM database 28 includes a 7-D Predetermined Building Information Modeling (BIM) database created for a building; wherein each element in the 7-D Predetermined Building Information Modeling (BIM) database comprises: a building component; its predetermined 3-D location coordinates; and its predetermined three angular coordinates.

In an embodiment of the present technology, referring still to FIG. 1A, the BIM database 28 includes an 8-D Predetermined Building Information Model (BIM) database created for a building; wherein each element in the 8-D Predetermined Building Information Model (BIM) database comprises: a building component; its predetermined 3-D location coordinates; its predetermined three angular coordinates; and a timing coordinate, that is the time of placing the building component into its predetermined 6-D location including its predetermined 3-D location coordinates and its predetermined three angular coordinates.

In an embodiment of the present technology, referring still to FIG. 1A, the BIM database 28 includes an 9-D Predetermined Building Information Modeling (BIM) database created for a building; wherein each element in the 9-D Predetermined Building Information Modeling (BIM) database comprises a building component; its predetermined 3-D location coordinates; its predetermined three angular coordinates; its timing coordinate; and an associated cost; wherein the timing coordinate indicates the time of placing the building component into its predetermined 6-D location including its predetermined 3-D location coordinates and its predetermined three angular coordinates.

In an embodiment of the present technology, referring still to FIG. 1A, the BIM database 28 includes a 10-D Predetermined Building Information Modeling (BIM) database created for a building; wherein each element in the 10-D Predetermined Building Information Modeling (BIM) database comprises a building component; its marking; its predetermined 3-D location coordinates; its predetermined three angular coordinates; its timing coordinate; and an associated cost; wherein the timing coordinate indicates the time of placing the building component into its predetermined 6-D location including its predetermined 3-D location coordinates and its predetermined three angular coordinates.

Table I summarizes all types of BIM databases discussed above.

TABLE 1

| 4-D BIM | 5-D BIM | 6-D BIM | 7-D BIM | 8-D BIM | 9-D BIM | 10-D BIM |
|---|---|---|---|---|---|---|
| Building component | Building component | Building component | Building component | Building component | Building component | Building component |
| 3-D coordinates | 3-D coordinates | 3-D coordinates | 3-D coordinates | 3-D coordinates | 3-D coordinates | 3-D coordinates |
| N/A | Timing coordinate | Timing coordinate | N/A | Timing coordinate | Timing coordinate | Timing coordinate |
| N/A | N/A | cost | N/A | N/A | cost | cost |
| N/A | N/A | N/A | 3-D angular coordinates | 3-D angular coordinates | 3-D angular coordinates | 3-D angular coordinates |
| N/A | N/A | N/A | N/A | N/A | N/A | Component marking |

Figure 4:
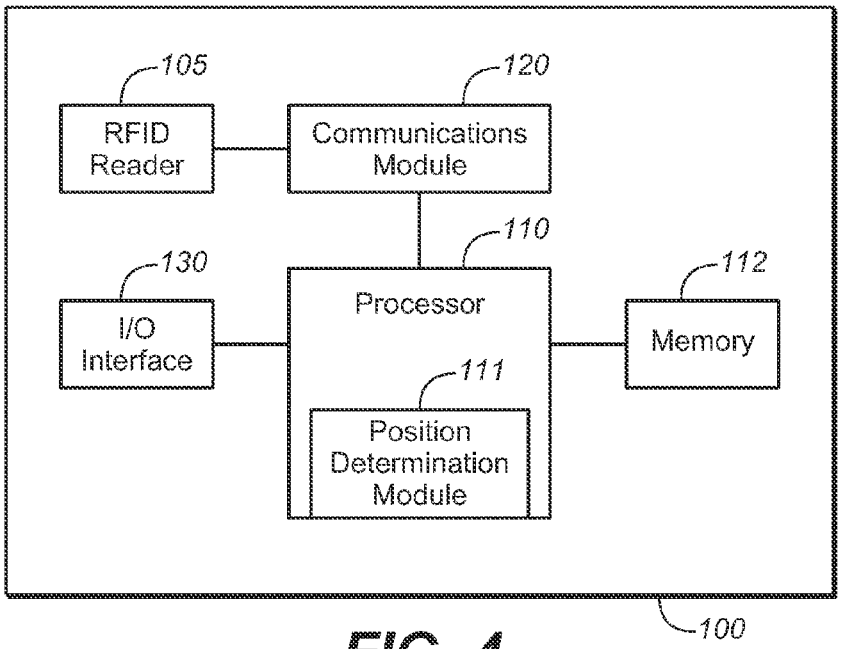
FIG. 4 depicts an RFID positioning system configured to verify the location of the RFID mounted on the building component for the purposes of the present technology.

In an embodiment of the present technology, FIG. 4 illustrates an RFID positioning system 100 (24 of FIG. 1A). The RFID positioning system 100 includes an RFID reader 105 that is operable to interact with RFID tags using an interrogation signal (38 of FIG. 1A).

In an embodiment of the present technology, the RFID positioning system 100 also includes a communications module 120, which can be integrated with the RFID reader 105 in some embodiments and used to transmit the interrogation signals in other embodiments. A processor 110 and memory 112 are included in the RFID positioning system. Processor 110 can process and output RFID data collected by the RFID reader 105 as well as data received from other sources through communications module 120. The processor can include a position determination module 111.

In an embodiment of the present technology, the position determination module 111 is implemented as a component of the RFID reader 105.

In an embodiment of the present technology, the processor 110 is implemented by using any type of processor such as a microprocessor, field programmable gate array (FPGA) and/or application specific integrated circuit (ASIC).

In an embodiment of the present technology, the processor 110 represents a central processing unit of any type of architecture, such as a CISC (Complex Instruction Set Computing), RISC (Reduced Instruction Set Computing), VLIW (Very Long Instruction Word), or a hybrid architecture, although any appropriate processor may be used. The processor 110 executes instructions and includes that portion of the RFID positioning system 100 that controls the operation of the entire system.

In an embodiment of the present technology, the processor 110 typically includes a control unit that organizes data and program storage in memory and transfers data and other information between the various parts of the system. The processor 110 is operable to receive input data from the various system components, read and stores code and data in memory 112, and present data to and receive data from the I/O interface 130.

Although the RFID positioning system 100 is shown to contain only a single processor 110 and a single memory 112, the disclosed embodiment applies equally to systems that may have multiple processors and multiple memories with some or all performing different functions in different ways.

Data received and/or processed by the processor 110 can be stored by memory 112, which represents one or more mechanisms for storing data. The memory 112 may include read-only memory (ROM), random access memory (RAM), magnetic disk storage media, optical storage media, flash memory devices, and/or other machine-readable media. In other embodiments, any appropriate type of storage device may be used. Although only one memory 112 is shown, multiple storage devices and multiple types of storage devices may be present.

The memory 112 includes a controller (not shown) and data items. The controller includes instructions capable of being executed on the processor 110 to carry out the methods described more fully throughout the present specification. In another embodiment, some or all of the functions are carried out via hardware in lieu of a processor-based system.

In an embodiment of the present technology, the controller is a web browser.

In an embodiment of the present technology, the controller includes a database system, a file system, an electronic mail system, a media manager, an image manager, or any other system capable of accessing data items. Data received and processed by the processor can be displayed using input/output interface 130, which may include a user interface for receiving and displaying data, images, and the like.

In an embodiment of the present technology a RFID reader 105 can be implemented by using ThingMagic® Mercury6 (M6) 4-port, multiprotocol RFID reader.

Depending on mobility, RFID readers are classified into two different types: fixed RFID and mobile RFID. If the reader reads tags in a stationary position, it is called fixed RFID. These fixed readers are set up specific interrogation zones and create a "bubble" of RF energy that can be tightly controlled if the physics is well engineered. This allows a very definitive reading area for when tags go in and out of the interrogation zone.

On the other hand, if the reader is mobile when the reader reads tags, it is called mobile RFID. Mobile readers include handhelds, carts and vehicle mounted RFID readers from manufacturers such as Motorola, Intermec, Impinj, Sirit, etc.

Trimble introduced the ThingMagic® Mercury6 (M6) 4-port, multiprotocol RFID reader as the latest addition to its RFID product family. The M6 is based on the ThingMagic M6e embedded RFID reader module and operates with the ThingMagic MercuryAPI, providing OEMs, VARs and end users with high-performance RFID and a common programming interface for enterprise RFID solution development.

Building on the ease of use, reliability and enterprise-grade performance ThingMagic products are known for, the M6 offers a low-profile form factor, and rugged service operating capabilities and the industry's highest transmit power for a Power over Ethernet (PoE) capable reader. These features make the M6 well suited for enterprise, commercial and industrial environments where high performance in a wide range of operating conditions is required.

Key features include: (1) Small form factor—Dimensions of 3.4 cm (Height)×19.0 cm (Length)×17.8 cm (Width) allow for the integration of enterprise-grade RFID into low profile portals, read stations, displays and a variety of other indoor and outdoor structures and environments. (2) Environmental rating—The M6 has an IP52 rating, providing dust ingress protection and water resistance for industrial, outdoor and rugged service requirements. (3) Transmit power—The M6 can operate at +5 to +31.5 dBm in both AC and PoE powered options, delivering superior performance for a wide range of applications. (4) Tag read performance—Configuration flexibility supports high sensitivity and high throughput operations. Superior receive sensitivity allows for a long read range (up to 30 ft) and an RFID tag read rate of 400 tags per second in typical read zone environments. (5) Power over Ethernet—Power over Ethernet (PoE) support provides ease of installation and low total cost of ownership. (6) Wi-Fi network connectivity—An integrated Wi-Fi network option provides low cost integration with existing enterprise Wi-Fi networks and Wi-Fi security standards.

In an embodiment of the present technology, building site 12 of FIG. 1A also includes a surveying tool (for instance, a Total Station 32) that uses a laser beam 34 to read a reflective target 18 on a building component 14 in order to determine its precise position coordinates.

In an embodiment of the present technology, the Total Station 32 is configured to determine a distance to the position of interest 20.

In an embodiment of the present technology, the Total Station 32 is configured to determine an angular offset (not shown) as 825, for the position of interest 20 in relation to the Total Station 32.

In an embodiment of the present technology, the Total Station 32 is configured to detect RFID tag 16, which may be associated with a position of interest 20. It is appreciated that RFID tag 16 can include position information, which may be used by the Total Station 32 to decode data. For example, the position information may provide a reference to determine the orientation of the RFID tag 16.

In an embodiment of the present technology, the Total Station 32 is Selected from the group consisting of: a Trimble ATS Construction Total Station; a Trimble® S6 DR Plus Total Station; and a TRIMBLE S8 Total Station.

Referring still to FIG. 1A, in an embodiment of the present technology, substantial majority of building components in the building site 12 (for example, the building component 14) are equipped with disposable and/or reusable, precision, reflective targets (for example, the reflective target 18) with an RFID tag in them (for example, the RFID tag 16) at the time of manufacturing.

Referring still to FIG. 1A, in an embodiment of the present technology, an RFID tag is programmed with the asset # of the component, 3D coordinate of where the target needs to be, ID of the person who placed the targets on the component, etc.

Referring still to FIG. 1A, in an embodiment of the present technology, a RFID tag is programmed on the fly by using the wireless computer 22 and the BIM database 28.

Referring still to FIG. 1A, in an embodiment of the present technology, when a building component is brought to site the RFID tags are read and loaded using the Trimble Access (TA) software program.

Referring still to FIG. 1A, in an embodiment of the present technology, the Trimble Access (TA) software program turns a robotic instrument (not shown) with a laser pointer to point to the design location of the 1st target and the component is moved into position. For example, the building component 14 is moved into location 20.

Referring still to FIG. 1A, in an embodiment of the present technology, the robotic instrument repeats the same operation for every building component. As-built measurements are taken to confirm that they are within tolerance. Many of these components could end up built into concrete structures so their positioning has to be right.

Referring still to FIG. 1A, in an embodiment of the present technology, the asset number and as built co-ordinates of a building component can be compared with the design by using RFID positioning system 24.

Referring still to FIG. 1A, in an embodiment of the present technology, the long range RFID tags can be mounted on a building component to allow easy monitoring and tracking during the construction of a building. The long range RFID tags equipped with a 30 Watt transmitter may be read by a portable RFID tag reader anywhere at the construction site.

Figure 5:
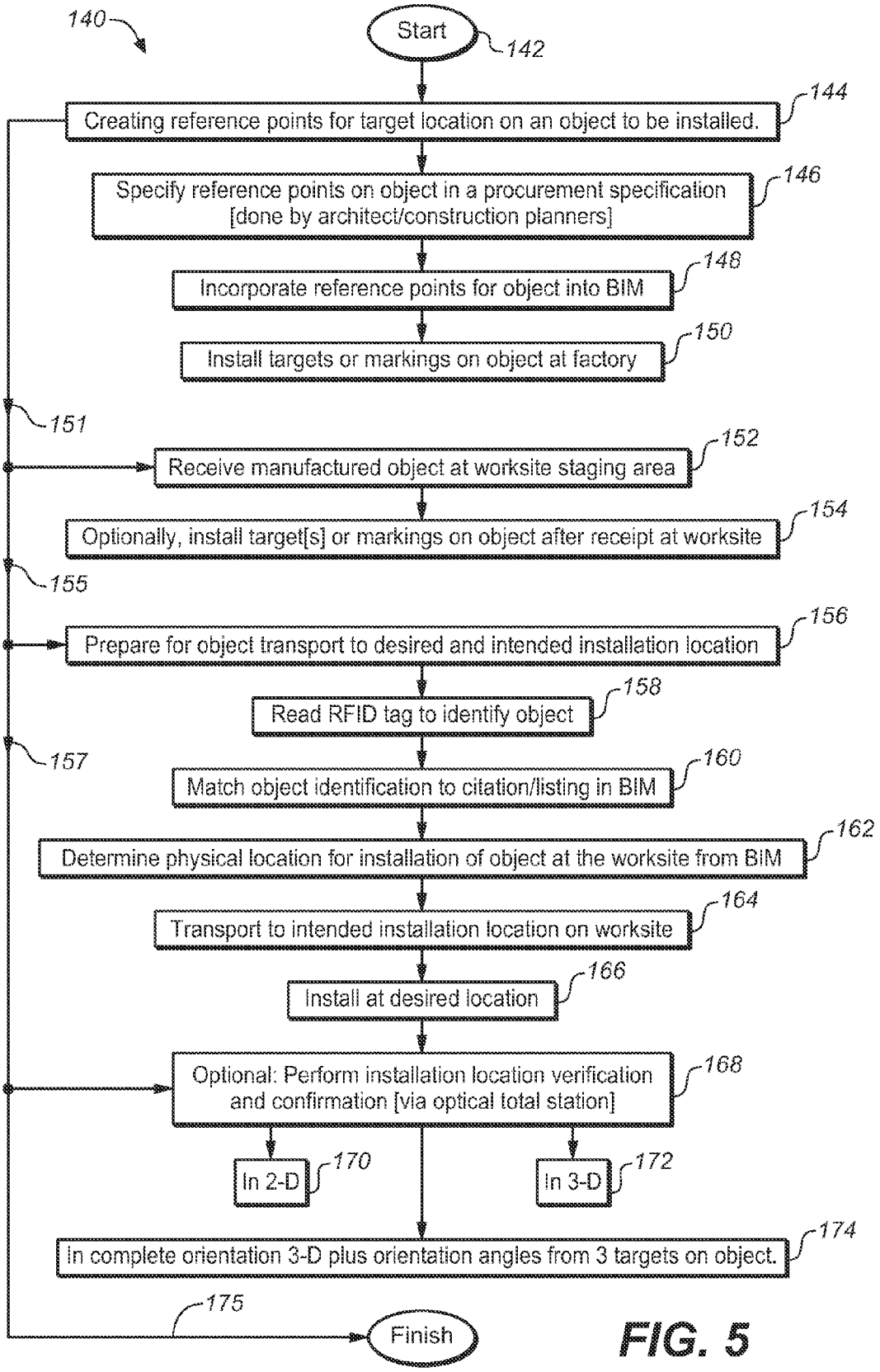
FIG. 5 is a flow chart that illustrates a method for aiding construction of a building of the present technology.

In an embodiment of the present technology, FIG. 5 is a flow chart 140 that illustrates a method for aiding construction of a building of the present technology.

In an embodiment of the present technology, the step 144 is a step of creating reference points for target location. For example, the step 144 illustrates the precise reference location 36 (of FIG. 1A) of the building component 14 (of FIG. 1A) to be installed.

In an embodiment of the present technology, as shown in FIG. 5, the step 144 comprises several steps (146, 148, and 150). More specifically, at the step 146, reference points on object in a procurement specification are specified. This is done by architect/construction planners.

In an embodiment of the present technology, at the step 148 the specified at the step 146 reference points for the building component (14 of FIG. 1A) are incorporated into the BIM, as shown in FIG. 5.

In an embodiment of the present technology, as shown in FIG. 5, at the step 150 the targets or physical markings are installed on the building component (14 of FIG. 1A) at the factory.

In an embodiment of the present technology, at the step 152, the manufactured building component (14 of FIG. 1A) is received at the worksite staging area, as illustrated in FIG. 5.

In an embodiment of the present technology, as shown in FIG. 5, at the step 154, optionally, additional markings are installed on the building component (14 of FIG. 1A) after receipt at worksite.

In an embodiment of the present technology, at the step 156, the building component (14 of FIG. 1A) is transported to desired and intended installation location (20 of FIG. 1A).

In an embodiment of the present technology, at the step 158, the RFID tag (16 of FIG. 1) is read to identify the building component (14 of FIG. 1A). The marking (18 of FIG. 1A) of the building component (14 of FIG. 1A) is matched with the object identification to citation/listing in BIM—step 160.

In an embodiment of the present technology, at the step 162, the physical location for installation of the building component (14 of FIG. 1A) is determined by assessing the BIM. The building component (14 of FIG. 1A) is transported to the installation location (20 of FIG. 1A) on the building site 12 (step 164), and installed at the desired location (20 of FIG. 1A) (step 166).

In an embodiment of the present technology, at the optional step 168, the installation location verification is performed and confirmed (for example, by using an optical total station). This operation can be done in 2-D space (step 170), or in 3-D space (step 172), or in complete orientation space 6-D (3-D plus orientation angles from 3 targets on object) (step 174).

The above discussion has set forth the operation of various exemplary systems and devices, as well as various embodiments pertaining to exemplary methods of operating such systems and devices. In various embodiments, one or more steps of a method of implementation are carried out by a processor under the control of computer-readable and computer-executable instructions. Thus, in some embodiments, these methods are implemented via a computer.

In an embodiment, the computer-readable and computer-executable instructions may reside on computer useable/readable media.

Therefore, one or more operations of various embodiments may be controlled or implemented using computer-executable instructions, such as program modules, being executed by a computer. Generally, program modules include routines, programs, objects, components, data structures, etc., that perform particular tasks or implement particular abstract data types. In addition, the present technology may also be practiced in distributed computing environments where tasks are performed by remote processing devices that are linked through a communications network. In a distributed computing environment, program modules may be located in both local and remote computer-storage media including memory-storage devices.

Although specific steps of exemplary methods of implementation are disclosed herein, these steps are examples of steps that may be performed in accordance with various exemplary embodiments. That is, embodiments disclosed herein are well suited to performing various other steps or variations of the steps recited. Moreover, the steps disclosed herein may be performed in an order different than presented, and not all of the steps are necessarily performed in a particular embodiment.

Although various electronic and software based systems are discussed herein, these systems are merely examples of environments that might be utilized, and are not intended to suggest any limitation as to the scope of use or functionality of the present technology. Neither should such systems be interpreted as having any dependency or relation to any one or combination of components or functions illustrated in the disclosed examples.

Although the subject matter has been described in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A method for aiding construction of a building, the method comprising:

accessing a Building Information Modeling (BIM) database to obtain building data for a building component, the building data including three-dimensional coordinates and angular coordinates for installation of the building component on a building site, the building data also including a timing coordinate indicating when the building component is to be installed on the building site;

downloading the building data to an RFID tag coupled to the building component;

setting up a specific interrogation zone using a plurality of fixed RFID readers, the specific interrogation zone surrounding the three-dimensional coordinates where the building component is to be installed, and controlling in real time installation of said building component having the RFID tag using the plurality of fixed RFID readers during construction of said building, such that an installed position of the building component and a time of the installation correspond to the three-dimensional coordinates, the angular coordinates, and the timing coordinate stored in the RFID tag.

2. The method of claim 1, wherein said BIM data includes a set of building data for said building during a building life cycle, wherein said set of building data includes a set of building components; and wherein said set of building data includes a set of location coordinates on said building site and wherein said set of building data includes a set of relationship between each said building component and at least one said set of location coordinates on said building site.

3. The method of claim 1, further comprising:

determining a sequence of building phases by accessing said Building Information Modeling (BIM) database;

wherein a first building phase of said building is selected from the group consisting of: a first floor of said building; a first wall of said building; and a first corner of said building;

and wherein a "k"-th building phase of said building is selected from the group consisting of: a "k"-th floor of said building; a "k"-th wall of said building; and a "k"-th corner of said building; k being an integer.

4. The method of claim 3, further comprising:

accessing said Building Information Modeling (BIM) database to derive data for a first set of building components, wherein said first set of building components includes a set of building components configured to build said first building phase of said building.

5. The method of claim 3, further comprising:

accessing said Building Information Modeling (BIM) database to derive data for said "k"-th set of building components, wherein said "k"-th set of building components includes a set of building components configured to build said "k"-th building phase of said building.

6. The method of claim 1, wherein said Building Information Modeling (BIM) database comprises an associated cost to install said building component.

7. The method of claim 1, further comprising:

selecting at least one of said fixed RFID readers from the group consisting of:

a Power over Ethernet (PoE) RFID reader; a High Power-Building Site distance RFID reader; and a RFID reader having Wi-Fi network connectivity.

8. The method of claim 1, further comprising:

integrating at least one of said fixed RFID readers with a communications module.

9. The method of claim 8, further comprising:

using said communications module to transmit at least one interrogation signal within said specific interrogation zone.

10. The method of claim 9, further comprising:

using said communications module to receive a set of RFID data collected by using said at least one interrogation signal.

11. The method of claim 9, further comprising:

controlling in real time when said building component having the RFID tag enters said specific interrogation zone during construction of said building by using said at least one interrogation signal.

12. The method of claim 1, further comprising:

integrating said RFID tag with a processor.

13. The method of claim 1, wherein at least one of said fixed RFID readers includes a position determination module; and the method further comprises:

processing a set of position determination data of said building component obtained by said position determination module, wherein said set of position determination data obtained by said position determination module determines whether said building component entered said interrogation zone.

14. The method of claim 1, further comprising:

measuring three-dimensional coordinates and angular coordinates of the building component after the installation; and verifying that the three-dimensional coordinates and the angular coordinates of the building component after the installation are within a pre-defined tolerance by comparing the three-dimensional coordinates and the angular coordinates of the building component after the installation with the three-dimensional coordinates and the angular coordinates stored in the RFID tag.

15. The method of claim 14, wherein the building component has a plurality of markings attached thereon, and measuring the three-dimensional coordinates and the angular coordinates of the building component after the installation is performed using an optical total station and the plurality of markings.

16. A method for aiding construction of a building on a building site, the method comprising:

providing a building component having at least one RFID tag and a plurality of building component markings coupled thereto;

accessing a Building Information Modeling (BIM) database to obtain building data for the building component, the building data including three-dimensional coordinates and angular coordinates for installation of the building component on the building site, the three-dimensional coordinates and the angular coordinates indicating a location and orientation of the plurality of building component markings when the building component is installed, the building data also including a timing coordinate indicating when the building component is to be installed on the building site;

downloading the building data to the RFID tag;

using an RFID reader to obtain the building data from the RFID tag; and installing the building component on the building site based on the building data obtained by the RFID reader such that an installed position of the building component and a time of the installation correspond to the three-dimensional coordinates, the angular coordinates, and the timing coordinate.

17. The method of claim 16, further comprising:

measuring three-dimensional coordinates and angular coordinates of the building component after the installation; and verifying that the three-dimensional coordinates and the angular coordinates of the building component after the installation are within a pre-defined tolerance by comparing the three-dimensional coordinates and the angular coordinates of the building component after the installation with the three-dimensional coordinates and the angular coordinates stored in the RFID tag.

18. The method of claim 17, wherein measuring the three-dimensional coordinates and the angular coordinates of the building component after the installation is performed using an optical total station and the plurality of building component markings.

* * * * *